US006973934B2

(12) United States Patent
Tsuga et al.

(10) Patent No.: US 6,973,934 B2
(45) Date of Patent: Dec. 13, 2005

(54) METHOD FOR REMOVING PARTICLES ON SEMICONDUCTOR WAFERS

(75) Inventors: Toshihito Tsuga, Tsuchiura (JP); Minoru Fube, Yamaga-machi (JP); Kazutaka Nakayama, Hiji-machi (JP)

(73) Assignee: Texas Instruments Incorporated, Dallas, TX (US)

( * ) Notice: Subject to any disclaimer, the term of this patent is extended or adjusted under 35 U.S.C. 154(b) by 548 days.

(21) Appl. No.: 10/072,073

(22) Filed: Feb. 8, 2002

(65) Prior Publication Data

US 2002/0166571 A1 Nov. 14, 2002

(30) Foreign Application Priority Data

Feb. 8, 2001 (JP) ..... 2001-032017

(51) Int. Cl.[7] ..... C25F 5/00

(52) U.S. Cl. ..... 134/1.3; 134/2; 134/3; 134/26; 134/28; 134/34; 438/906

(58) Field of Search ..... 134/1.3, 2, 3, 26, 134/28, 34, 41; 438/906

(56) References Cited

U.S. PATENT DOCUMENTS 5,733,434 A * 3/1998 Harada et al. ..... 205/746
6,004,399 A * 12/1999 Wong et al. ..... 134/2
6,158,445 A * 12/2000 Olesen et al. ..... 134/1.3
6,378,534 B1 * 4/2002 Olesen et al. ..... 134/1.3
6,444,255 B2 * 9/2002 Nagahara et al. ..... 427/108
6,488,037 B1 * 12/2002 Guldi ..... 134/1.3

* cited by examiner

*Primary Examiner*—M. Kornakov
(74) *Attorney, Agent, or Firm*—Rose Alyssa Keagy; W. James Brady, III; Frederick J. Telecky, Jr.

(57) ABSTRACT

The purpose of the present invention is to remove minute particles adhered to the surface of semiconductor wafers effectively in the cleaning process of semiconductor wafers. In the final rinsing step using ultra-pure water or hydrogen water and carried out after cleaning of semiconductor wafers with HF solution, ultrasonic waves are irradiated in the cleaning solution after a prescribed time delay (preferably 20–30 sec or more).

16 Claims, 3 Drawing Sheets

FIG. 1
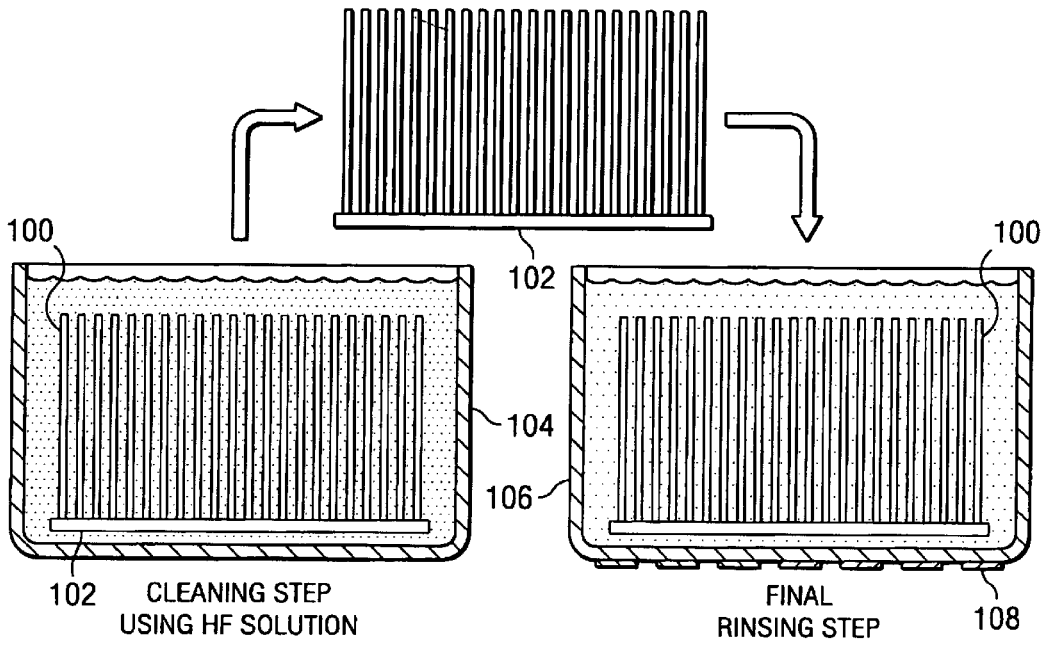
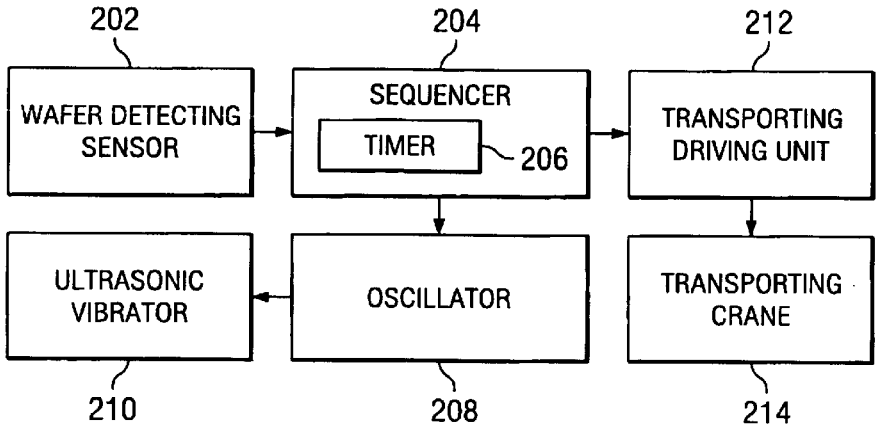
FIG. 2

METHOD FOR REMOVING PARTICLES ON SEMICONDUCTOR WAFERS

FIELD OF THE INVENTION

The present invention pertains to a method for cleaning semiconductor wafers. In particular, the present invention pertains to a method for removing particles adhered to the surface of semiconductor wafers.

BACKGROUND OF THE INVENTION

Accompanying the demand for higher integration levels and higher semiconductor device density is the increasing demand for cleanliness with respect to minute foreign objects on the surfaces of semiconductor wafers becomes. Consequently, in order to increase the manufacturing yield of semiconductor chips, it is necessary to remove foreign objects effectively by means of cleaning of semiconductor wafers.

Cleaning of semiconductor wafers includes multiple processes for removing minute particles made of many types of impurities, such as metal impurities, organic impurities, silicon, etc., from the surfaces of semiconductor wafers. In the cleaning process, the semiconductor wafers are cleaned sequentially in multiple cleaning solution tanks where various types of cleaning solutions are circulated. Multiple semiconductor wafers are held in any tray for transportation, and they are set in the cleaning solution tanks for prescribed cleaning times. In the following, the typical cleaning processing steps that are embodied at present will be shown.

(1) In order primarily to remove minute particles on the surfaces of semiconductor wafers, the semiconductor wafers are carried into a cleaning solution tank of SC-1 (ammonia/hydrogen peroxide aqueous solution: $NH_4OH/H_2O_2/H_2O$) and cleaned for 10 min.

(2) Then, in order to wash off SC-1 from the surfaces of the semiconductor wafers, the aforementioned semiconductor wafers are carried into a cleaning solution tank containing ultra-pure water and rinsed for about 10 min.

(3) Then, in order primarily to remove metal impurities and organic impurities on surfaces of the semiconductor wafers, the semiconductor wafers are carried into a cleaning solution tank of SC-2 ($HCl/H_2O_2/H_2O$) and cleaned for about 10 min.

(4) Then, in order to wash off SC-2 from the surfaces of the semiconductor wafers, the aforementioned semiconductor wafers are carried into a cleaning solution tank containing ultra-pure water and rinsed for about 10 min.

(5) Then, in order primarily to remove silicon oxide film (natural oxide film) from the surfaces of semiconductor wafers, the aforementioned semiconductor wafers are carried into a cleaning solution tank of a hydrogen fluoride solution (diluted HF, FPM ($HF/H_2O_2/H_2O$) cleaning solution, etc.) and cleaned for 1–5 min.

(6) As the last step, in order to wash off the HF (hydrogen fluoride) solution, the aforementioned semiconductor wafers are carried into a cleaning solution tank containing ultra-pure water and rinsed for 10 min.

However, in the aforementioned typical cleaning processes, minute particles cannot be easily removed. This is a problem. This is because in the aforementioned fifth step of operation, minute particles of silicon oxide film that peel off the surface of the semiconductor wafers become attached to the surface of the bare silicon. Then, in the sixth step of operation, the minute particles cannot be washed off. That is, with an acidic HF solution, the potential of the silicon wafer surface and that of the surface of the main minute particles are opposite in sign, so that they attract each other, and particle removal cannot take place by rinsing only with ultra-pure water.

In order to solve this problem, the conventional cleaning process adopts the following method: an ultrasonic vibrator is placed in the cleaning solution tank used in the aforementioned sixth step of operation, so that ultrasonic waves are irradiated for a prescribed time on the ultra-pure water or hydrogen-enriched ultra-pure water (ultra-pure water enriched with 0.3–1.6 ppm of hydrogen) while rinsing is performed. However, it is still difficult to remove the minute particles with this method.

Consequently, the purpose of the present invention is to provide a method that can effectively remove the minute particles adhering to the surface of semiconductor wafers.

SUMMARY OF THE INVENTION

The present invention provides a method for removing particles on semiconductor wafers characterized by the fact that the method for removing particles adhered to the surface of semiconductor wafers is comprised of the following steps of operation: a step in which the semiconductor wafers are dipped in a cleaning solution tank to which a cleaning solution is fed; and a step in which ultrasonic waves are fed into the aforementioned cleaning solution after the passage of a prescribed amount of time since the time that the aforementioned semiconductor wafers were dipped in the aforementioned cleaning solution.

The present inventors found that in the aforementioned process of the present invention, since the generation of ultrasonic waves in the cleaning solution where the semiconductor wafers are dipped is delayed for a prescribed time, the efficiency for removing minute particles adhered to the surface of semiconductor wafers becomes significantly higher. In the prior art, minute particles adhered to the surface of semiconductor wafers become detached from the surface under physical impact by means of the cavitation effect of the ultrasonic waves. However, in the cleaning step using HF solution as the former step, the silicon oxide film on surfaces of semiconductor wafers is etched. Consequently, on surfaces of semiconductor wafers pulled from the cleaning solution tank, together with the chemical solution, the etched silicon oxide film is also mixed in a colloidal state (a type of minute particles). Also, many minute particles are scattered from the edge and inner surface of the semiconductor wafers, and they also become mixed with the aforementioned chemical solution. In this way, when the semiconductor wafers are dipped in the cleaning solution and irradiated ultrasonically in this step of operation, some of the gas bubbles (cavitation) generated in the cleaning solution stay on the surface of the semiconductor wafers by means of surface tension, some of which contain the aforementioned minute particles. Consequently, according to studies made by the present inventors, in the process of the present invention, ultrasonic waves are not generated at the beginning. Instead, ultrasonic waves are generated after a prescribed period of time after removal of the HF solution on the surface of semiconductor wafers is carried out to a certain extent. As a result, it is less possible for the minute particles in the HF solution to be included in cavitation gas bubbles, so that the minute particles can be removed effectively.

As a preferred embodiment, the aforementioned prescribed time is 20 sec or more.

Also, the aforementioned prescribed time may be set corresponding to a substitution ratio of cleaning solution in the cleaning solution tank of 0.4 or more (assuming that the substitution ratio is unity when cleaning solution in the same amount is fed per unit time into a cleaning solution tank of unit volume).

In a preferred embodiment, the aforementioned cleaning time of semiconductor wafers is 600 sec or longer.

In a preferred embodiment, the aforementioned time for feeding ultrasonic waves is 400 sec or longer.

In addition, the aforementioned cleaning solution may be ultra-pure water, or hydrogen-enriched ultra-pure water, or preferably, hydrogen-enriched ultra-pure water doped with 0.3–1.6 ppm of hydrogen.

Also, it is preferred that the cleaning operation of semiconductor wafers using ultrasonic waves be performed after the step of operation in which the semiconductor wafers are cleaned with a cleaning solution mainly made of hydrogen fluoride.

BRIEF DESCRIPTION OF THE DRAWINGS

FIG. 1 is a schematic diagram illustrating the various processes of the final rinsing step of the present invention as well as the preceding cleaning step using HF solution.

FIG. 2 is a control block diagram illustrating the embodiment of the final rinsing step in the present invention.

REFERENCE NUMERALS AS SHOWN IN THE DRAWINGS

Figure 3:
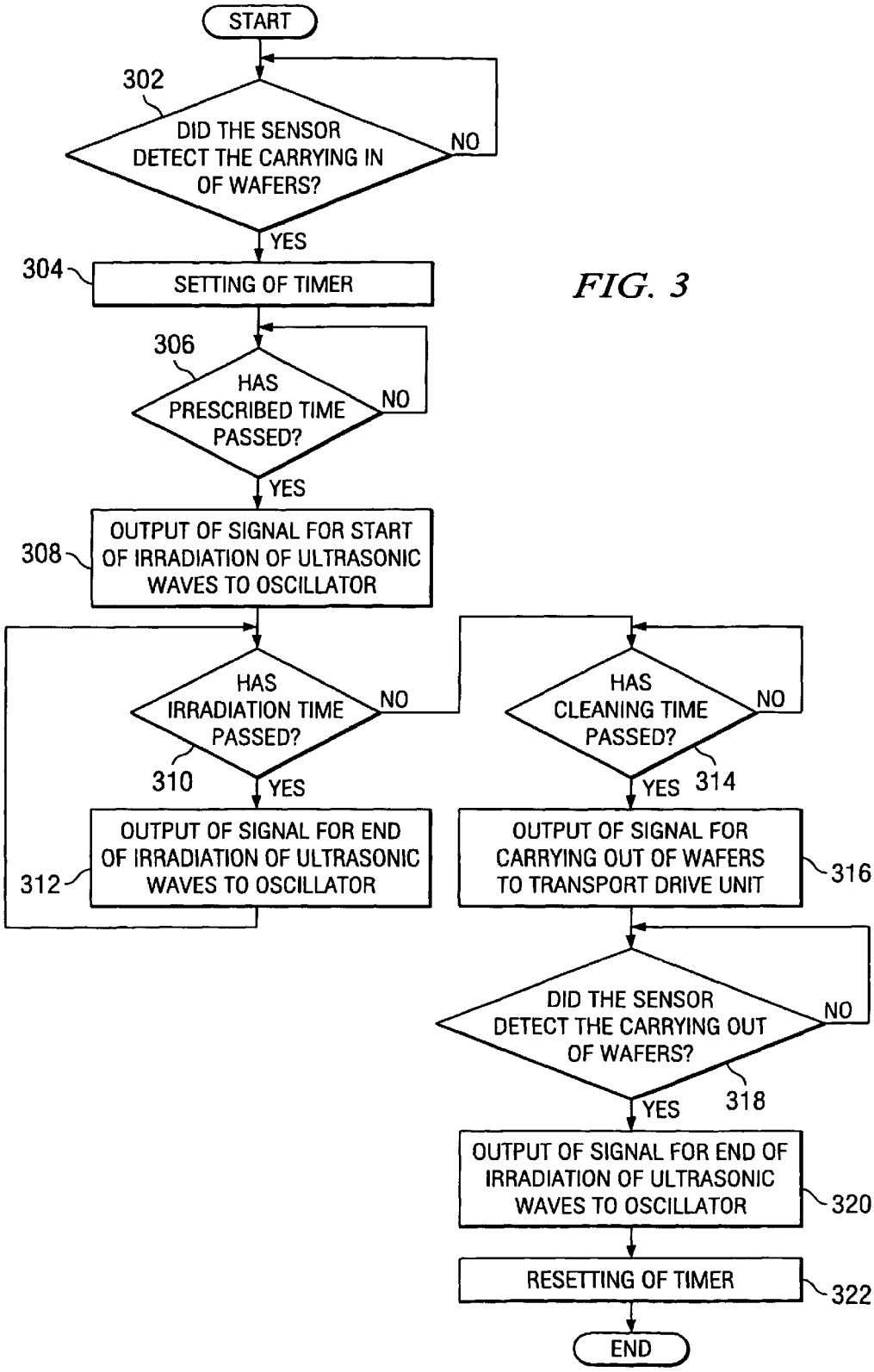
FIG. 3 is a flow chart illustrating control in the sequencer shown in the control block.

In the figures, 100 represents a semiconductor wafer, 102 a tray, 104, 106, a cleaning solution tank, 108, a ultrasonic vibrator, 202, a wafer detecting sensor, 204, a sequencer, 206, a timer, 208, a transmitting circuit, 210, an ultrasonic vibrator, 212, a transporting driving unit, and 214, a transporting crane.

DESCRIPTION OF THE EMBODIMENTS

In the following, the present invention will be explained in detail with reference to an embodiment illustrated by figures. The method for removing particles from semiconductor wafers of the present invention is preferably adopted in the final rinsing step in the aforementioned typical cleaning process of semiconductor wafers. FIG. 1 is a schematic diagram illustrating the final rinsing step of the present invention, as well as the preceding cleaning step using HF solution.

Multiple semiconductor wafers 100 are held in tray 102 of any type, and they are transported to cleaning solution tanks for washing by means of a transporting crane not shown in the figure. After treatment in said cleaning processing steps (1)–(4), semiconductor wafers 100 are loaded into cleaning solution tank 104 of HF solution, and are cleaned for 1–5 min. In this case, most of the natural oxide film on the surface of the semiconductor wafers is removed. After the cleaning time in the cleaning step using HF solution, the transporting crane is activated, and semiconductor wafers 100 are hoisted from cleaning solution tank 104. Then, they are carried into cleaning solution tank 106 for performing the final rinsing step of the present invention.

In cleaning solution tank 106 for performing the final rinsing step, ultra-pure water (UPW) or hydrogen-enriched ultra-pure water enriched with 0.3–1.6 ppm of hydrogen (hereinafter referred to as hydrogen water) is added (hereinafter referred to as cleaning water). Cleaning water is fed continuously into cleaning solution tank 106 by a feeding means not shown in the figure when at least semiconductor wafers 100 are in the cleaning solution tank. Ultrasonic vibrator 108 is placed in cleaning solution tank 106. It generates ultrasonic waves at a prescribed frequency to be irradiated on the cleaning water in cleaning solution tank 106. According to the present invention, when this final rinsing step is carried out, irradiation of ultrasonic waves is started after a prescribed time from the time that semiconductor wafers are carried into cleaning solution tank 106. The specific embodiment sequence will be explained below. In this final rinsing step, HF solution on the surface of semiconductor wafers is washed off using the aforementioned cleaning water, and at the same time, minute particles mixed in the solution are effectively removed.

FIG. 2 is a control block diagram illustrating an embodiment of the final rinsing step of the present invention. Ultrasonic vibrator 210 and transporting crane 214 of semiconductor wafers are driven under on the basis of the control signal from sequencer 204. Sequencer 204 has timer 206, which receives the detection signal from wafer detecting sensor 202 and is started (set) or stopped (reset). Wafer detecting sensor 202 is set above or inside cleaning solution tank 106 shown in FIG. 1, and it detects whether semiconductor wafers 100 are present in cleaning solution tank 106.

Sequencer 204 is constituted such that it monitors the time measured by timer 206 and outputs prescribed control signals when the preset times, that is, the prescribed time, irradiation time, and cleaning time are reached. In this case, the aforementioned prescribed time determines the time when irradiation of ultrasonic wave is started. It defines the time that has passed from the time when semiconductor wafers 100 are carried into cleaning solution tank 106. In a prescribed embodiment, the prescribed time is in the range of 30–180 sec. The aforementioned cleaning time is the time for setting semiconductor wafers 100 in cleaning solution tank 106. In a prescribed embodiment, it is about 10 min (600 sec). The aforementioned irradiation time determines the time for irradiating ultrasonic waves in cleaning solution tank 106. Consequently, the longest irradiation time is defined as (cleaning time—prescribed time). However, it is also possible to select a shorter time as the irradiation time. These preset times can be changed as desired by the user. For example, the aforementioned prescribed time can be selected in the range of 20–180 sec, and the aforementioned cleaning time can be selected to be about 300 sec. The prescribed control signal is sent from sequencer 204 to emitter 208, which pumps ultrasonic vibrator 210, so that ultrasonic wave is irradiated in the cleaning solution tank. Also, sequencer 204 sends out the prescribed control signal to transport driving unit 212. As a result, transporting crane 214 is started, and semiconductor wafers 100 are carried out from cleaning solution tank 106.

FIG. 3 is a flow chart illustrating the control of the sequencer shown in the aforementioned control block. In the following, the control of sequencer 204 of the present invention will be examined. Control with reference to FIGS. 2 and 3 is started as wafer detecting sensor 202 detects that semiconductor wafers 100 are carried into cleaning solution tank 106. That is, wafer detecting sensor 202 detects when semiconductor wafers 100 are carried by transporting crane 214 into cleaning solution tank 106, which performs the final rinsing step, and sends the detection signal to sequencer 204 [302]. When the detection signal is input, sequencer 204 sets timer 206 to start measurement of time [304]. Sequencer 204 monitors the time measured by timer 206, and maintains a stand-by state without sending the control signal until the end of the aforementioned prescribed time. Consequently, the final rinsing process is performed by only feeding the cleaning water without irradiating ultrasonic waves until the end of the aforementioned prescribed time. In this process, the HF solution is washed from the surface of each semiconductor wafer 100.

Timer 206 measures the prescribed time. When sequencer 204 senses it [306], sequencer 204 outputs to transmitting circuit 208 a signal that starts irradiation of ultrasonic waves [308]. Transmitting circuit 208 receives it and activates ultrasonic vibrator 210 placed in the cleaning solution tank. In this way, ultrasonic waves are irradiated in cleaning solution tank 106, and, by means of the physical impact based on the cavitation effect, removal of minute particles from surfaces of semiconductor wafers 100 is accelerated.

Then, when sequencer 204 determines that a prescribed irradiation time has passed [310], sequencer 204 outputs a signal that terminates irradiation of ultrasonic waves to transmitting circuit 208 [312]. Upon receiving it, transmitting circuit 208 terminates activation of ultrasonic vibrator 210. On the other hand, when sequencer 204 senses that no irradiation time is set or irradiation is to be terminated before the end of the prescribed irradiation time [314], a control signal for transporting semiconductor wafers 100 out from cleaning solution tank 106 is output to transporting driving unit 212 [316]. Upon receiving this signal, transporting driving unit 212 starts transporting crane 214 in order to transport semiconductor wafers 100 from cleaning solution tank 106. As transporting crane 214 is started so that semiconductor wafers 100 are transported from cleaning solution tank 106 in a normal state, wafer detecting sensor 202 detects this state and notifies sequencer 204 [318]. Upon receiving this detection signal, sequencer 204 outputs to transmitting circuit 208 a signal that terminates irradiation of ultrasonic waves [320]. Upon receiving this signal, transmitting circuit 208 terminates activation of ultrasonic vibrator 210. Then, sequencer 204 resets timer 322, and it becomes the stand-by state until next cycle of transporting semiconductor wafers into cleaning solution tank 106. By means of the aforementioned operation, control executed for a series of steps of the final rinse process comes to an end.

The present inventors conducted experiments to check the effects and determine optimum times of the present invention. In the initial experiment, silicon wafers (with initial residual ratio of minute particles/6 inches of 5 or fewer) were cleaned with HF solution (FPM: 0.5 wt % HF, 0.5 wt % $H_2O_2$ solution for 10 min. Then, final rinsing was performed for 10 min using the conventional method and the method of the present invention, and the residual minute particles were counted. The final rinsing process was performed as follows.

COMPARATIVE EXAMPLE 1

Cleaning was perfomed with ultra-pure water without using ultrasonic waves.

COMPARATIVE EXAMPLE 2

Cleaning was performed with ultrasonic waves, and with ultrasonic waves irradiated from the beginning.

COMPARATIVE EXAMPLE 3

Cleaning was performed with hydrogen water (without adding $NH_4OH$ (ammonium hydroxide)), and with ultrasonic waves irradiated from the beginning.

COMPARATIVE EXAMPLE 4

Cleaning was performed with hydrogen water (added with $NH_4OH$), and with ultrasonic waves irradiated from the beginning.

Embodiment 1-1: Cleaning was performed with hydrogen water (without adding $NH_4OH$), and with ultrasonic waves irradiated for a prescribed time of 120 sec according to the present invention.

Embodiment 1-2: Cleaning was performed with hydrogen water (added with $NH_4OH$), and with ultrasonic waves irradiated for a prescribed time of 120 sec according to the present invention.

Figure 4:
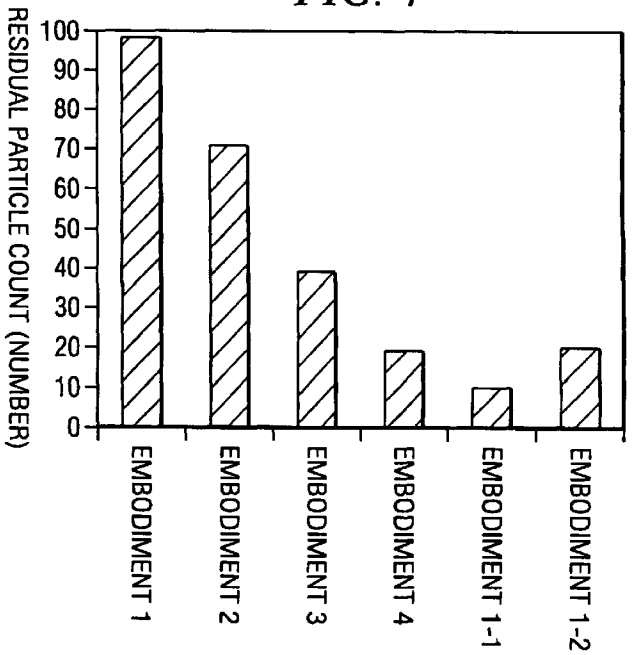

In each final rinsing step, the cleaning solution was fed at a rate of 15.0 L/min into a 18.24-L cleaning solution tank. Output of the ultrasonic waves was 10. MHz and 4.1 W/cm$^2$. Also, measurement of the residual particles was performed for particles of 0.2 $\mu$m or larger using a laser scattering type particle counter. The results are shown in FIG. 4.

As can be seen from the aforementioned results, when ultrasonic irradiation is performed after a prescribed delay time in the final rinsing process, the removal rate of minute particles adhered to the surface of the semiconductor wafers can be increased significantly.

Then, under the same experimental conditions (Embodiment 1–1), the prescribed delay time to initiate ultrasonic irradiation was changed in the range of 0-180 sec to determine the influence of the prescribed time ont he removal rate of the minute particles. The results are shown in FIG. 5.

Figure 5:
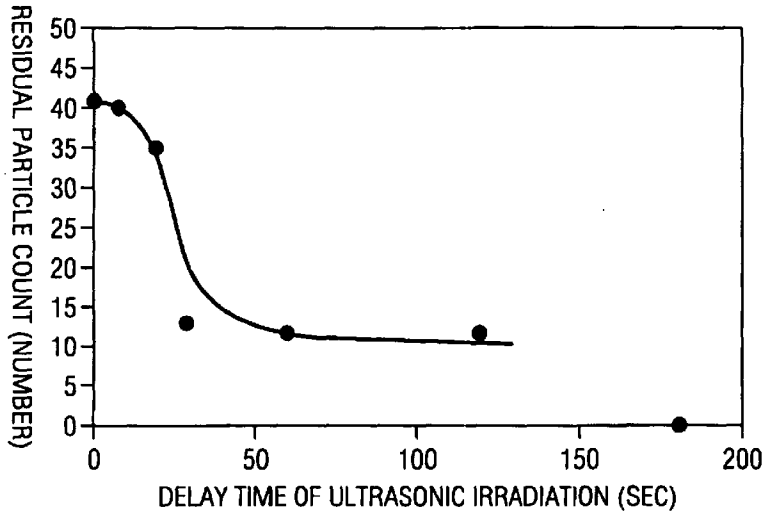
Figure 6:
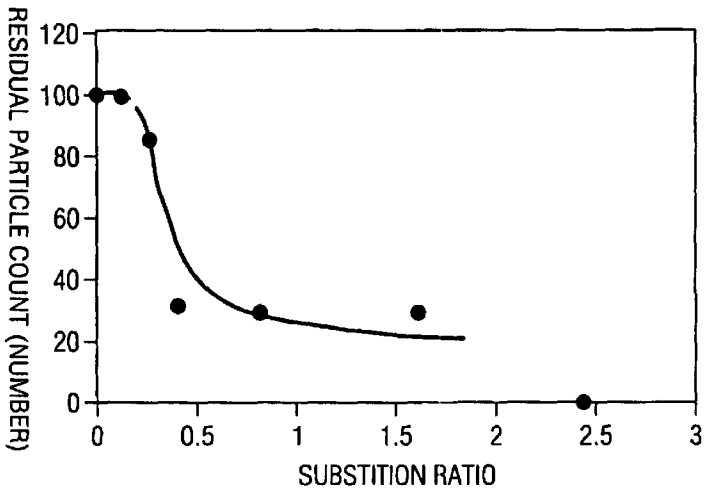

Also, the value of the graph shown in FIG. 5 was plotted versus the substitution ratio of the cleaning solution with respect to the cleaning solution tank, as shown in FIG. 6. In this case the results of the above graph are converted to relative values, with unity defined as the case when the same amount of cleaning solution is fed per unit time (min) into a cleaning solution tank of unit volume (L).

As can be seen from the results shown in FIGS. 5–6, in order to remove minute particles effectively, it is preferred that the prescribed time be 20–30 sec or longer, and the substitution ratio of the cleaning solution with respect to the cleaning solution tank be 0.4 or higher. Also the values for the residual particle count listed in FIGS. 4–6 refer to the results measured with respect to 6-inch semiconductor wafers.

What is claimed is:

1. A method for cleaning semiconductor wafers comprising:

dipping semiconductor wafers in a cleaning solution tank to which a cleaning solution is fed;

feeding ultrasonic waves into the cleaning solution after the passage of a prescribed period of time since the time that the semiconductor wafers are dipped in the cleaning solution;

wherein the prescribed period of time is 20 sec or more.

2. The method for cleaning semiconductor wafers described in claim 1 wherein the prescribed time corresponds to a substitution ratio of the cleaning solution in the cleaning solution tank of 0.4 or more.

3. The method for cleaning semiconductor wafers described in claim 1 wherein a time for the feeding ultrasonic waves into the cleaning solution is 400 sec or more.

4. The method for cleaning semiconductor wafers described in claim 3 wherein a total cleaning time for the semiconductor wafers is 600 sec or more.

5. The method for cleaning semiconductor wafers described in claim 1 wherein the cleaning solution is ultrapure water.

6. The method for cleaning semiconductor wafers described in claim 1 wherein the cleaning solution is hydrogen-enriched ultra-pure water.

7. The method for cleaning semiconductor wafers described in claim 6 wherein a concentration of hydrogen in the hydrogen-enriched ultra-pure water is in the range of 0.3–1.6 ppm.

8. The method for cleaning semiconductor wafers described in claim 1 wherein the step of cleaning semiconductor wafers ultrasonically is performed after the step of cleaning semiconductor wafers by means of a cleaning solution mainly comprising hydrogen fluoride.

9. The method for cleaning semiconductor wafers described in claim 2 wherein the cleaning solution is hydrogen-enriched ultra-pure water.

10. The method for cleaning semiconductor wafers described in claim 3 wherein the cleaning solution is hydrogen-enriched ultra-pure water.

11. The method for cleaning semiconductor wafers described in claim 4 wherein the cleaning solution is hydrogen-enriched ultra-pure water.

12. The method for cleaning semiconductor wafers described in claim 2 wherein the step of cleaning semiconductor wafers ultrasonically is performed after the step of cleaning semiconductor wafers by means of a cleaning solution mainly comprising hydrogen fluoride.

13. The method for cleaning semiconductor wafers described in claim 3 wherein the step of cleaning semiconductor wafers ultrasonically is performed after the step of cleaning semiconductor wafers by means of a cleaning solution mainly comprising hydrogen fluoride.

14. The method for cleaning semiconductor wafers described in claim 4 wherein the step of cleaning semiconductor wafers ultrasonically is performed after the step of cleaning semiconductor wafers by means of a cleaning solution mainly comprising hydrogen fluoride.

15. The method for cleaning semiconductor wafers described in claim 5 wherein the step of cleaning semiconductor wafers ultrasonically is performed after the step of cleaning semiconductor wafers by means of a cleaning solution mainly comprising hydrogen fluoride.

16. The method for cleaning semiconductor wafers described in claim 6 wherein the step of cleaning semiconductor wafers ultrasonically is performed after the step of cleaning semiconductor wafers by means of a cleaning solution mainly comprising hydrogen fluoride.

* * * * *